US007730688B2

(12) United States Patent
Pfeiffer

(10) Patent No.: US 7,730,688 B2
(45) Date of Patent: Jun. 8, 2010

(54) CORNER TIE BRACKET FOR USE WITH INSULATED CONCRETE FORM SYSTEMS

(75) Inventor: Henry E. Pfeiffer, Omaha, NE (US)

(73) Assignee: Reward Wall Systems, Inc., Omaha, NE (US)

( * ) Notice: Subject to any disclaimer, the term of this patent is extended or adjusted under 35 U.S.C. 154(b) by 162 days.

(21) Appl. No.: 11/861,720

(22) Filed: Sep. 26, 2007

(65) Prior Publication Data

US 2008/0155925 A1 Jul. 3, 2008

Related U.S. Application Data

(60) Provisional application No. 60/882,006, filed on Dec. 27, 2006.

(51) Int. Cl.
*E04B 1/38* (2006.01)
*E04B 2/00* (2006.01)
*E04C 1/00* (2006.01)

(52) U.S. Cl. ..... 52/426; 52/285.1; 52/309.11; 52/562; 52/565

(58) Field of Classification Search ..... 52/426, 52/285.1, 309.11, 309.12, 562, 565
See application file for complete search history.

(56) References Cited

U.S. PATENT DOCUMENTS

| | | | |
|---|---|---|---|
| 4,604,843 | A | 8/1986 | Ott et al. |
| 4,706,429 | A | 11/1987 | Young |
| 4,730,422 | A | 3/1988 | Young |
| 4,866,891 | A | 9/1989 | Young |
| 4,885,888 | A | 12/1989 | Young |
| D383,373 | S | 9/1997 | Boeshart |
| 6,230,462 | B1 | 5/2001 | Beliveau |
| 6,820,384 | B1 | 11/2004 | Pfeiffer |
| 6,931,806 | B2 * | 8/2005 | Olsen ..... 52/309.11 |

(Continued)

FOREIGN PATENT DOCUMENTS

WO WO 2006098800 A1 * 9/2006

OTHER PUBLICATIONS

"laterally." The American Heritage® Dictionary of the English Language, Fourth Edition. Houghton Mifflin Company, 2004. Nov. 2, 2009. <Dictionary.com http://dictionary.reference.com/browse/laterally>.*

*Primary Examiner*—Basil Katcheves
*Assistant Examiner*—Branon C Painter
(74) *Attorney, Agent, or Firm*—Husch Blackwell Sanders LLP

(57) ABSTRACT

A corner bracket member for use in an Insulated Concrete Form (ICF) corner block or other form assembly having a pair of opposed inner and outer spaced apart panels for receiving concrete therebetween, the corner bracket member including at least a pair of side members, each side member having at least a pair of spaced apart flange members adapted for receiving and anchoring exterior facade or other surfaces thereto, and at least one concrete engaging member positioned and located so as to extend in a direction completely across the space formed by and between the inner and outer panels associated with the ICF corner block. The side members and flange members of the corner bracket member are encapsulated within one of the inner and outer panels and the at least one concrete engaging member includes a terminal end portion which is encapsulated within the other of the inner and outer panels when attached thereto.

17 Claims, 4 Drawing Sheets

U.S. PATENT DOCUMENTS

| | | | | |
|---|---|---|---|---|
| 7,082,731 | B2 | 8/2006 | Patz et al. | |
| 2003/0000169 | A1 | 1/2003 | Davidsaver | |
| 2007/0175155 | A1* | 8/2007 | Cymbala et al. | 52/562 |
| 2008/0229692 | A1* | 9/2008 | Crosby et al. | 52/426 |

* cited by examiner

CORNER TIE BRACKET FOR USE WITH INSULATED CONCRETE FORM SYSTEMS

CROSS-REFERENCE TO RELATED APPLICATION

This application claims the benefit of U.S. Provisional Patent Application No. 60/882,006, filed on Dec. 27, 2006, the disclosure of which is incorporated herein by reference.

BACKGROUND OF INVENTION

The present invention relates to Insulated Concrete Form systems utilizing foam block forms and, more particularly, to an improved corner tie bracket for use in a wide variety of different types of Insulating Concrete Form (ICF) systems.

Insulating Concrete Form (ICF) systems are known and serve to both contain fluid concrete while it solidifies and provide insulation for the finished structure. Such systems utilize a plurality of individual units, panels or blocks aligned horizontally and vertically in an interlocking arrangement to create forms for concrete walls. Each block typically includes a pair of foam panels which are retained in a spaced relationship parallel to each other by a plurality of spaced apart ties which include opposing flange portions which reside within respective opposing foam panels. The opposing flange portions are separated by an intermediate web portion connected therebetween enabling the tie to hold and secure the panel portions. These tie flanges typically run substantially the vertical height of the ICF blocks and typically serve as a stud or anchor to which interior and exterior facades can be anchored and attached.

Corner tie brackets are likewise molded within foam ICF blocks configured to function as corner form blocks for concrete poured therebetween. Such corner type brackets are likewise intended to serve as anchors for exterior surfaces fastened to the exterior surface of the finished concrete wall. However, since the known corner tie brackets often times either do not include any type of concrete engaging member, or such concrete engaging member does not extend all the way across the space formed by and between the pair of foam panels forming the corner block at the corner, such known corner tie brackets are not anchored or embedded within the inner corner panel at its corner. Due to the forces generated by the flowing fluid concrete during the pouring process, blow out of the corner foam panels can occur because the corner tie bracket is not anchored to the inside corner panel and, as a result, the corner block is not adequately reinforced by the corner tie bracket. Also, some of the known prior art corner tie brackets have flange dimensions that yield flanges that are incapable of functioning as anchors for attaching exterior facade, or such corner tie bracket flanges do not provide sufficient surface area and/or spacing for properly attaching certain types of exterior facade thereto.

It is therefore desirable to provide a corner tie bracket for use with a wide variety of different types of ICF systems which provide a bridging member between the inside and outside corner panels forming the corner block to prevent the corner block from blowing out; which yields flanges that are capable of functioning as anchors for supporting a wide variety of different types of exterior facades; which provides greater flexibility for attaching exterior finishes thereto; and which provides more attachment options for attaching exterior facades thereto.

Accordingly, the present invention is directed to overcoming one or more of the problems as set forth above.

SUMMARY OF INVENTION

The corner tie bracket of the present invention overcomes the weaknesses and disadvantages associated with prior art designs and teaches a more versatile and stronger corner tie bracket design. The present corner tie bracket includes a pair of corner side members connected to a structural web member, the corner side members sharing a common end and extending substantially perpendicularly from each other, each bracket side member including a pair of spaced apart flanges adapted for receiving and holding exterior siding or facade which may be attached thereto. These corner side flanges extend in the vertical direction and are of sufficient height, width and thickness so as to serve as a stud to which exterior facades can be anchored. A concrete engaging member extends outwardly away from the structural web member and is offset from the common end portion or joinder of the pair of corner bracket side members. The concrete engaging member extends inwardly across the space formed by and between the two ICF panels forming the corner block and includes a free end portion which is completely encapsulated within the inner corner panel member at its corner. In similar fashion, the corner bracket side members and their associated flanges along with the structural web member are all encapsulated within the foam outer corner panel member to which exterior siding or facade will be attached. The concrete engaging member extends completely across and bridges the space formed by and between the inner and outer corner panels forming the corner block member and is likewise completely encapsulated by concrete when it is poured within the space between the corner panels. This arrangement reinforces and strengthens the corner tie bracket member within the opposed panels forming the corner ICF block; it reinforces the entire corner ICF block; and it provides flanges that are capable of functioning as anchors to hold exterior facade. In addition, since each corner bracket side member includes a pair of vertically extending flanges to which exterior facade could be attached, the present corner tie bracket provides greater flexibility and more attachment options and the forces and loads exerted and transmitted from any exterior facade attached thereto are more evenly distributed over the entire corner tie bracket thereby improving the structural load carrying capacity of the corner tie bracket.

In one embodiment, a pair of the present corner tie brackets are utilized in a typical corner ICF block, one corner tie bracket being associated with the upper portion of a particular corner block and the other corner tie bracket being associated with the lower portion of the particular corner block, the pair of corner tie brackets being vertically stackably positioned in reversed relationship to each other and being dimensioned such that the facade attaching flanges associated therewith extend substantially the full height of the corner block. In another embodiment, the pair of corner tie brackets described above could be formed into a single unitary unit thereby eliminating the need for utilizing two corner tie brackets within each respective corner ICF block, or one of the present corner tie brackets could be sized, shaped and dimensioned such that the facade attaching flanges extend substantially the full vertical height of the particular corner ICF block into which it will be inserted including adding additional web members and additional concrete engaging members to add additional strength and rigidity to the overall corner tie bracket. This improved corner tie bracket structure reinforces the corner block and helps to prevent a blow out and, when surrounded by concrete poured between opposing corner panels, provides for easy and stable installation of exterior siding or facade.

These and other objects and advantages of the present invention will become more apparent to those skilled in the art after considering the following specification when taken in conjunction with the accompanying drawings wherein similar characters of reference refer to similar structures in each of the specific views.

DETAILED DESCRIPTION

Figure 1:
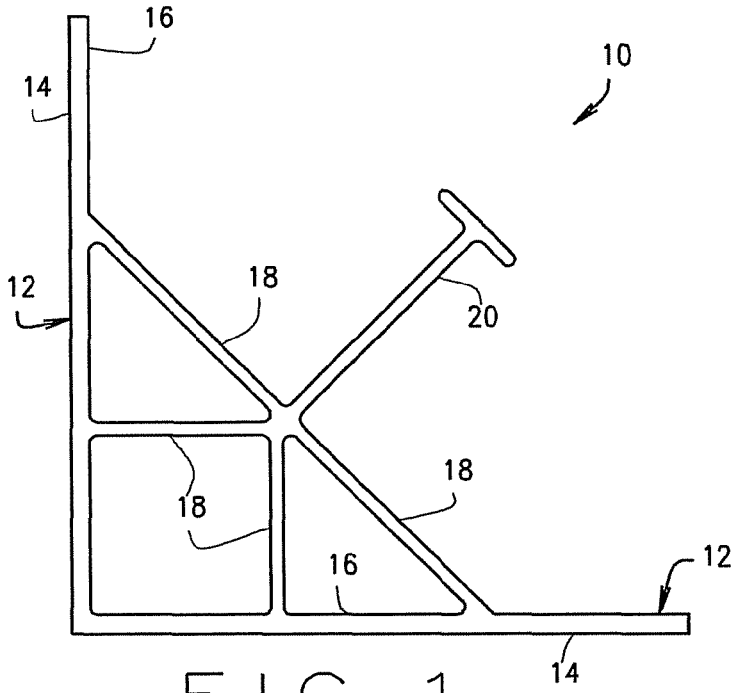
FIG. 1 PRIOR ART
FIG. 1 is an enlarged plan view of a prior art corner tie bracket.

FIG. 1 illustrates a typical prior art corner tie bracket 10 having a pair of flange members 12 sharing a common end and extending perpendicularly from each other, each flange member 12 having an outer surface 14 and an inner surface 16. An array of web members 18 connects the inner surfaces 16 of each flange 12. A concrete engaging member 20 extends inwardly from the web 18 at substantially a 45° angle from either flange 12.

Figure 2:
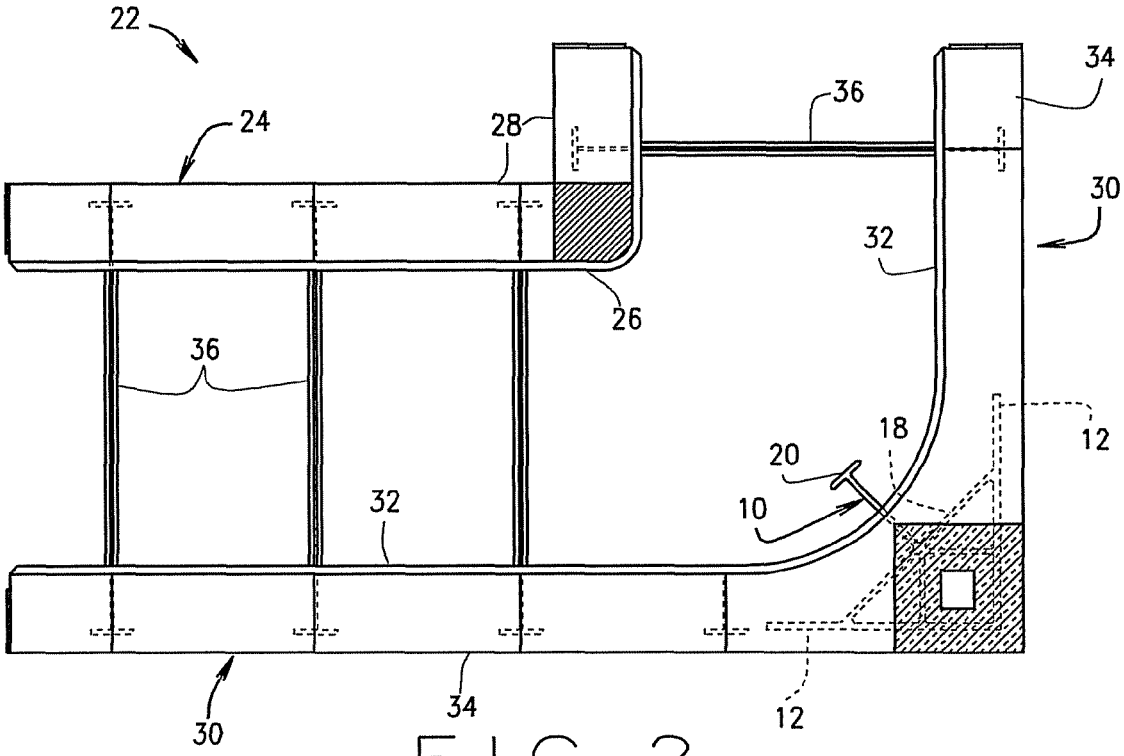
FIG. 2 PRIOR ART
FIG. 2 is a plan form view of a typical ICF corner foam form block utilizing the prior art corner tie bracket illustrated in FIG. 1.

A typical corner ICF block 22 is illustrated in FIG. 2 and includes an inner corner panel 24 having an inner surface 26 and an outer surface 28, an outer corner panel 30 having an inner surface 32 and an outer surface 34, and a plurality of conventional ties 36 having opposed flange portions encapsulated within a respective panel 24 and 30, thereby holding and retaining the corner panels 24 and 30 in opposing fashion. The corner block 22 may include any type of engaging means formed along respective opposed longitudinal and vertical edges for removably cooperatively vertically and horizontally engaging any plurality of ICF blocks including the corner block 22 associated with a particular ICF system.

As illustrated in FIG. 2, the flange members 12 associated with corner tie bracket 10 are completely encapsulated within the outer corner panel 30 at its corner. The concrete engaging member 20 extends from the web 18 inwardly beyond the inner surface 32 of the outer block 30 thereby enabling the concrete engaging member 20 to be completely encapsulated by concrete when it is poured between the corner panels 24 and 30. Importantly, the concrete engaging member 20 does not extend completely across the space formed by and between the inner and outer corner panels 24 and 30 as illustrated, and the concrete engaging member 20 is not encapsulated within the inner corner panel 24 at its corner. In addition, the corner tie flanges 12 do not include exterior facade attaching flange members which run substantially the vertical height of the corner block 22.

Figure 3:
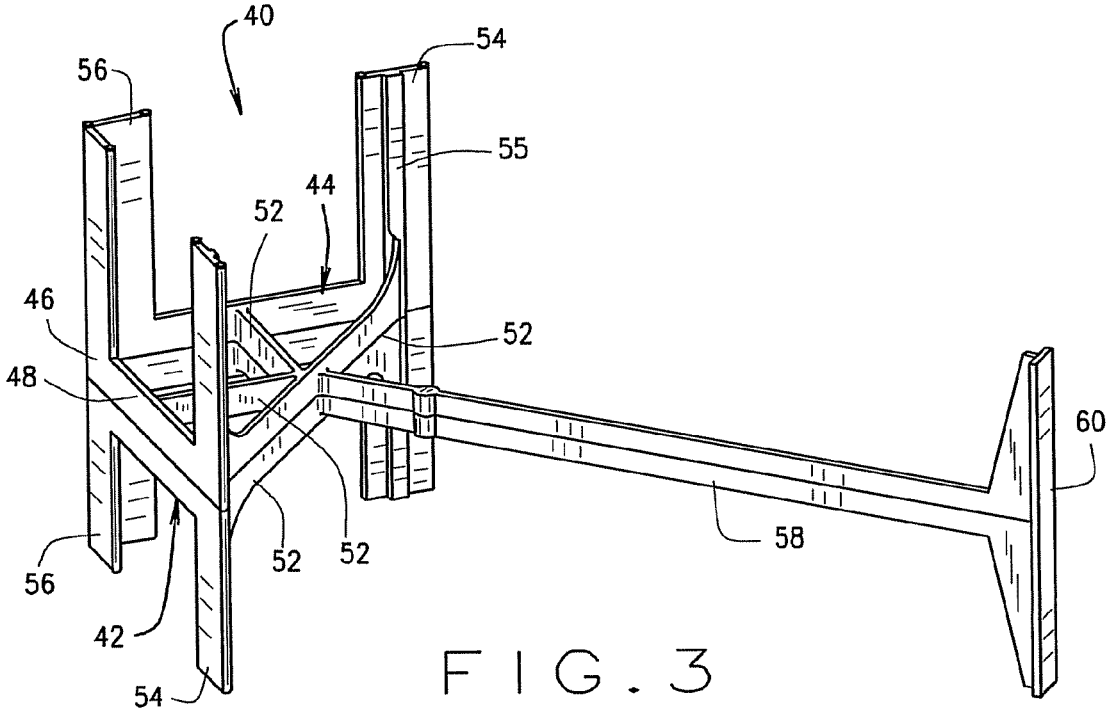
FIG. 3 is a perspective view of one embodiment of a corner tie bracket constructed in accordance with the teachings of the present invention.
Figure 4:
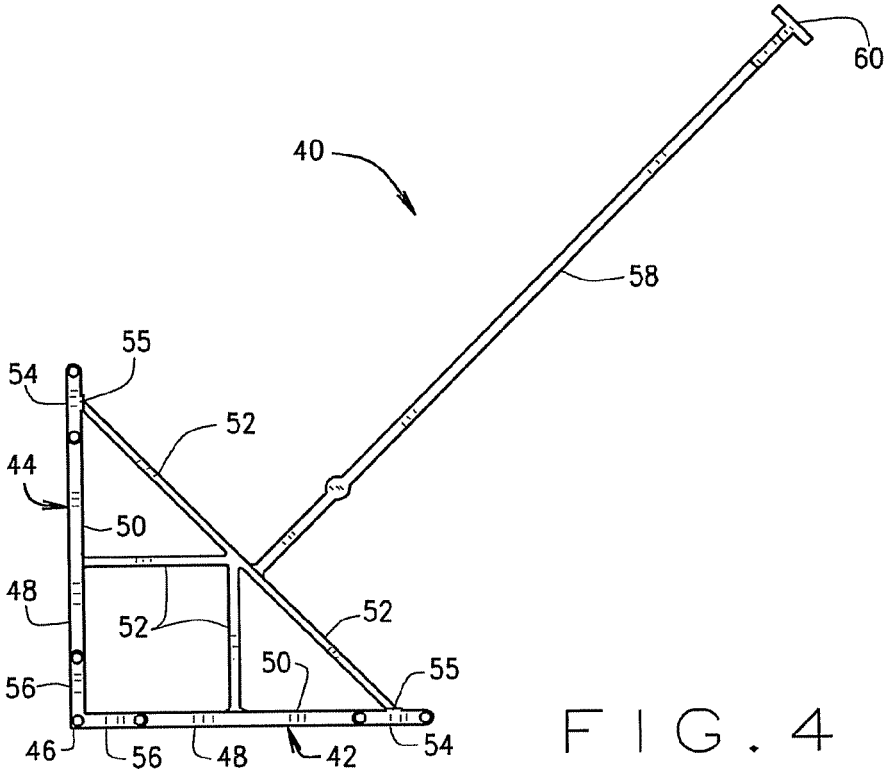
FIG. 4 is a top plan form view of the corner tie bracket of FIG. 3.
Figure 5:
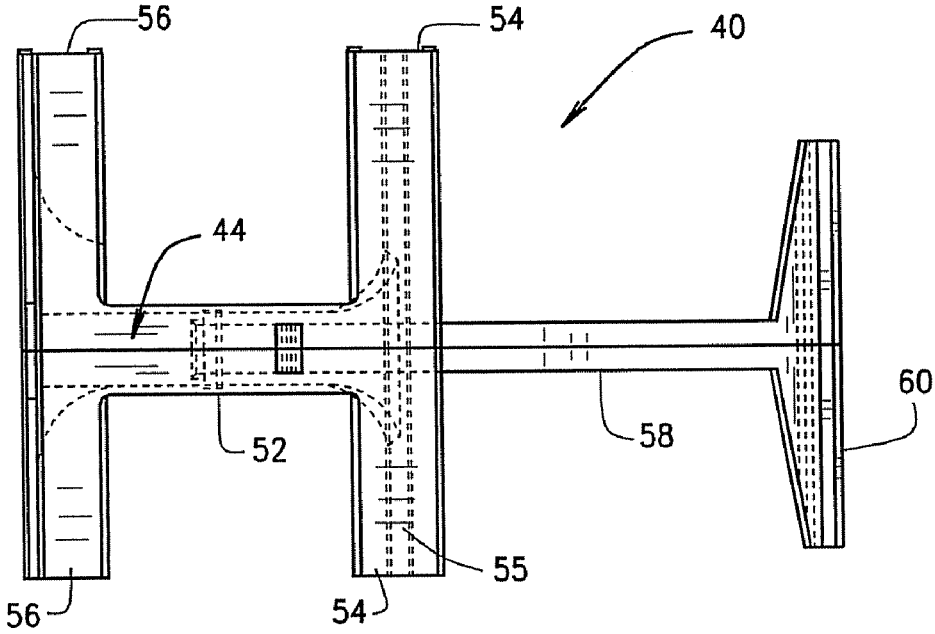
FIG. 5 is a left side elevational view of the corner tie bracket of FIG. 4.

One embodiment of the present corner tie bracket 40 of the present invention is illustrated in FIGS. 3, 4 and 5. The tie bracket 40 includes a pair of corner side members 42 and 44 sharing a common end portion 46 and extending substantially perpendicularly from each other, each side member 42 and 44 having an outer surface 48 and an inner surface 50. An array of web members 52 connect the inner surfaces 50 of each bracket side member 42 and 44 as best illustrated in FIG. 4. The web members 52 provide strength and stability to the overall tie bracket 40 and it is recognized that any web structure can be used without impacting the present invention.

Each bracket side member 42 and 44 includes at least a pair of spaced apart flange members 54 and 56 respectively adapted for receiving and anchoring exterior facade or other surfaces which can be attached thereto. The corner side flange members 54 and 56 extend in a vertical direction as best illustrated in FIGS. 3 and 5 and are of sufficient height, width and thickness so as to serve as a stud to which exterior facades can be attached. In the embodiment illustrated in FIGS. 3-5, the respective flange members 56 share a common edge and such members could be formed as a single unitary L-shaped member attachable or otherwise formed as an integral portion of side members 42 and 44 such that a portion of the flange member 56 extends adjacent each respective bracket side member 42 and 44 as illustrated in FIGS. 3 and 4. It is also recognized and anticipated that the flange members 56 do not have to share a common edge and that such flange members could be spaced from each other or spaced from the corner edge of bracket side members 42 and 44. One or both of the flange members 54 and 56 may likewise include a ridge or area 55 (FIGS. 3-5) of extra material to further increase the strength of such flange member and to provide a thicker area for attaching exterior facade thereto. The ridge or area 55 could also taper off in thickness towards the respective side edges of the bracket flange 54 and/or 56. It is also recognized and anticipated that any number of the flange members 54 and 56 could be associated with each bracket side member 42 and 44 depending upon the particular application and the particular type of facade or other surface to be attached to the corner tie bracket 40.

The corner tie bracket 40 also includes a concrete engaging member 58 or other equivalent support member which extends outwardly away from the array of web members 52 and is offset from the bracket corner or edge 46 as best illustrated in FIG. 4. When installed in a typical corner ICF block, the concrete engaging member extends inwardly across the space formed by and between the two ICF panels forming the corner block and includes a terminal end portion 60 which is completely encapsulated within the inner corner panel member at its corner as will be hereinafter explained. The terminal end portion 60 is elongated in the vertical direction so as to provide additional strength and rigidity to the overall bracket 40 when it is encapsulated within the inner corner panel 24 (FIGS. 6 and 7) and it likewise provides a flange surface which can serve as a stud for attaching other surfaces thereto.

Figure 6:
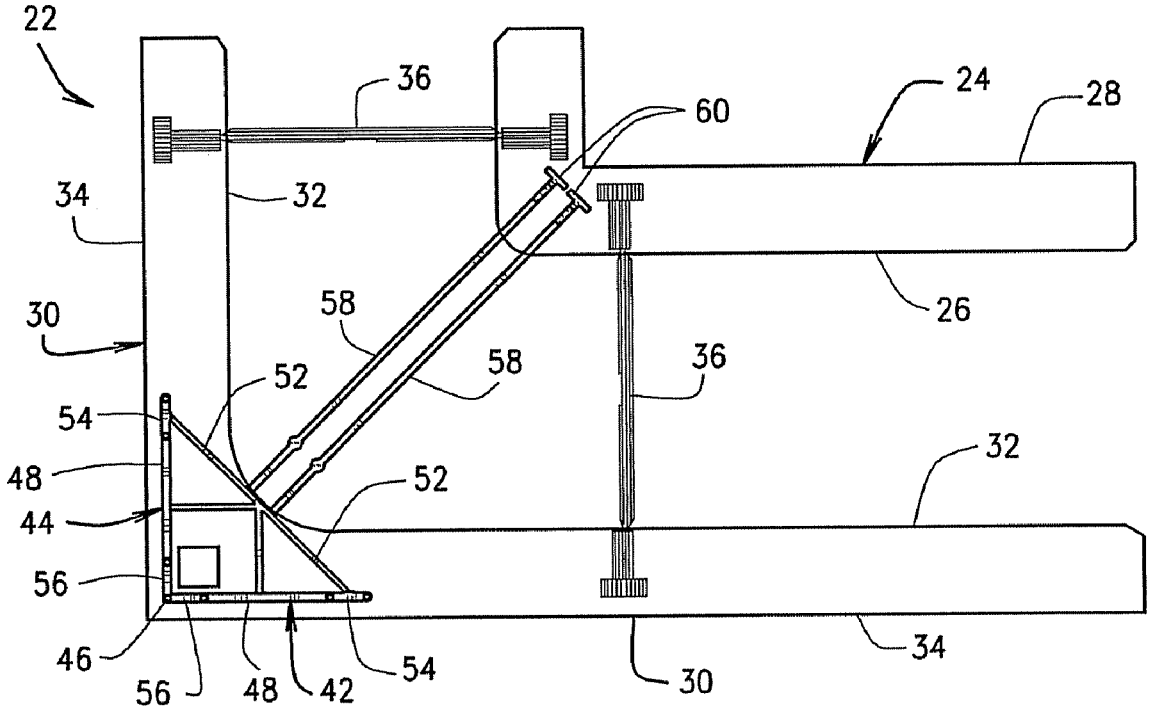
FIG. 6 is a top plan form view of a typical ICF corner foam form block illustrating use of a pair of the present corner tie brackets of FIG. 1.
Figure 7:
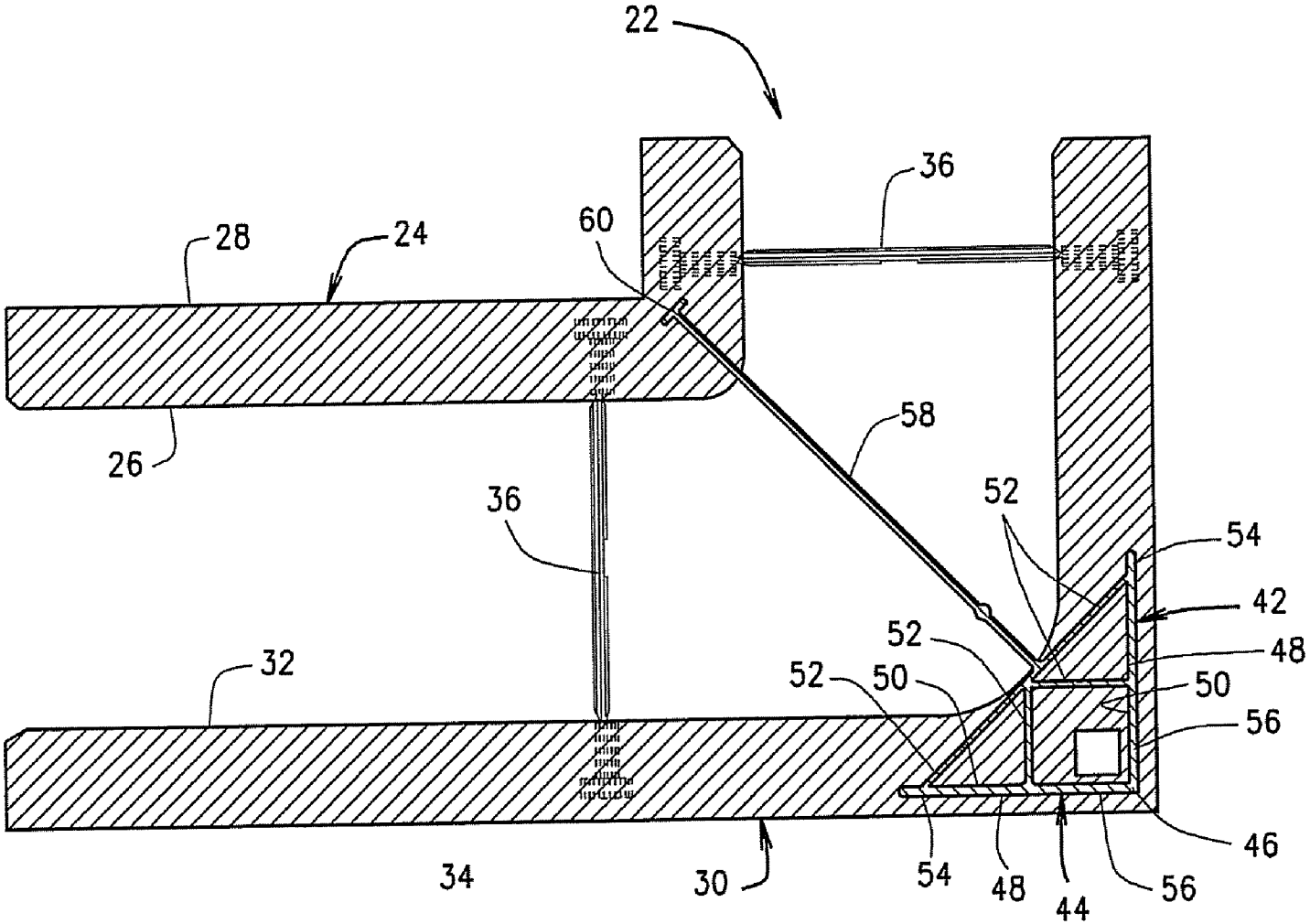
FIG. 7 is a cross-sectional view taken horizontally through the corner block of FIG. 6 between the two respective corner tie brackets showing the installation of just one of the corner tie brackets of FIG. 1.

A typical corner block 22 is again illustrated in FIGS. 6 and 7 including an inner corner panel 24 having an inner surface 26 and an outer surface 28, an outer corner panel 30 having an inner surface 32 and an outer surface 34, and a plurality of conventional ties 36 as previously described with respect to FIG. 2. FIGS. 6 and 7 also illustrate use of the present corner tie bracket 40 in a typical corner block 22 and, as illustrated, the corner bracket side members 42 and 44 and their associated flange members 54 and 56 along with the structural web members 52 are all encapsulated within the foam outer corner panel member 30 to which exterior facade or siding would be attached. In the embodiment illustrated in FIG. 6, a pair of corner side brackets 40 are utilized in the corner block 22 and such brackets are vertically stackably arranged in reversed relationship to each other such that the concrete engaging member 58 associated with one of the corner tie brackets 40 is offset to one side of the bracket corner 46 whereas the concrete engaging member 58 associated with the other corner tie bracket 40 is offset to the opposite side of the bracket corner 46. In this embodiment, the corner tie brackets 40 are sized and shaped such that when the two tie brackets 40 are positioned one on top of the other in reversed relationship, the flange members 54 and 56 mate with each other and extend substantially the full height of the corner block 22. Also, importantly, the concrete engaging members 58 illustrated in FIG. 6 extend completely across and bridge the space formed by and between the inner and outer corner panels 24 and 30 and their terminal end portions 60 are completely encapsulated within the corner associated with the inner corner panel 24 as illustrated in FIG. 6. This means that the concrete extending member 58 extends from the web members 52 inwardly to the opposite corner portion of the corner block 22 thereby enabling the concrete engaging member 58 to be completely encapsulated by concrete when it is poured between the corner panels 24 and 30.

Since the concrete engaging member 58 extends all the way across the space formed between the respective inner and outer corner panels 24 and 30, and since each respective end portion of the corner tie bracket 40 is embedded within the respective inner and outer corner panels as previously explained, the corner tie brackets 40 are securely embedded within the corner block 22 and the concrete wall formed therebetween thereby providing strength throughout the entire height of the corner block 22 as well as providing additional strength and stability to the corner tie brackets 40 themselves such that the flange members 54 and 56 are adequately secured to the resulting concrete wall so that they can serve as a stud or anchor for holding exterior facade. This structure also reinforces the entire corner block 22 and helps to prevent the corner block from blowing out during the concrete pouring process due to the forces generated by the flowing concrete when filling the corner block. The encapsulation of both ends of the concrete engaging member 58 provides a bridging member between the inner and outer panels 24 and 30 which greatly reduces the possibility of a blow out. Also, since each corner tie bracket 40 includes a pair of flanges 54 and 56 associated with each respective side member 42 and 44, the loads and forces exerted and transmitted to the corner tie brackets 40 from anchoring exterior corner facade thereto are more evenly distributed over the corner brackets 40 thereby improving the structural load carrying capability of such brackets. Also, this arrangement provides for greater flexibility and more attachment surface options for attaching exterior facade to the bracket flanges 54 and 56, and it simplifies and makes easier the installation of such exterior facade. When a plurality of corner ICF blocks 22 are used in conjunction with other ICF blocks to form a concrete wall, use of the present corner tie brackets 40 in each respective corner block 22 will yield facade attaching flange members 54 and 56 which will extend substantially the full height of the concrete wall. This not only improves the structural integrity of the formed concrete wall at its corners, but it also facilitates anchoring exterior facade thereto as explained above.

FIG. 7 is a horizontal cross-sectional view of FIG. 6 taken between the two respective corner tie brackets 40 utilized therein, showing a single corner tie bracket 40 positioned within either the upper or lower half of the corner block 22. In this regard, it is recognized and anticipated that any number of corner tie brackets 40 could be stackably arranged in a single corner block such as the corner block 22, depending upon the overall height of the corner block, and it is likewise recognized and anticipated that a single corner tie bracket 40 could be sized, shaped and dimensioned so as to extend the full height of the particular corner block into which it is embedded such that the facade attaching flange members 54 and 56 associated therewith extend substantially the full vertical height of that particular corner block. This unitary construction may require adding additional web members such as the members 52 to the corner tie bracket 40 as well as either increasing the size and/or shape of the concrete engaging member 58 or adding additional concrete engaging members 58 in spaced apart vertical relationship to the bracket. Still further, the pair of corner tie brackets 40 utilized in the embodiment illustrated in FIG. 6 could likewise be formed into a single unitary bracket. Economies associated with manufacturing processes and techniques may dictate the overall size, shape and dimensions associated with a particular corner tie bracket 40 and such brackets can be made in any size depending upon the particular application. It is also recognized and anticipated that any number of corner tie brackets 40 could likewise be utilized in any particular application.

To facilitate locating the flange members 54 and 56 associated with the corner tie brackets 40, a pair of flange indicators (not shown) are typically molded into the outer surface 34 of outer corner panel 30 to visually identify the location of the respective flange members 54 and 56. A plurality of spaced horizontal indicators may likewise be molded into the outer surface of the corner panels 30 and positioned between the previous pair of indicators to form a ladder tie identification design to further visually identify the location of the flange members 54 and 56. This ladder tie identification design makes it easy for a worker to quickly and easily identify and locate the flange members 54 and 56 associated with each respective corner tie bracket 40 for both aligning the respective tie brackets 40 when the corner blocks 22 are vertically stacked one upon another to create a wall structure, and for serving as anchoring studs. Once the poured concrete has cured, the concrete engaging member 58 prevents the corner tie bracket 40 from being displaced from the corner block 22 due to any anchor forces incurred by the mounting of any facade thereto.

It is also recognized and anticipated that the corner panels 24 and 30 can take on a wide variety of different dimensions and thicknesses so as to yield corner blocks such as the block 22 having an interior space or cavity adaptable for receiving fluid concrete therein which will yield a wide variety of different concrete wall thicknesses acceptable for both commercial and residential construction. In addition, it is recognized and anticipated that the corner tie brackets 40 can likewise be dimensioned having flange lengths and widths adaptable for a wide variety of different applications and for serving as anchoring studs for a wide variety of different types of facades. It is also recognized that the concrete engaging member 58 can likewise take on a wide variety of different sizes and shapes and such member does not need to be offset from the bracket corner 46 as illustrated, but can be centered and can extend along a line in alignment with the bracket corner 46. Still further, it is recognized and anticipated that the bracket side members 42 and 44 could be positioned and located anywhere along the height of the respective flange members 54 and 56 such that the side members 42 and 44 could be offset towards one end portion of the flange members 54 and 56 as best shown in FIG. 5, or such members 42 and 44 could be centered therebetween. Other variations are also recognized and anticipated. In this regard, it is further recognized and anticipated that the blocks 22 may take on a wide variety of lengths and heights and that any number of corner tie brackets 40 may be employed at predetermined locations along the height of the corner block 22 for particular applications. Still further, it is recognized and understood that any of a variety of dimensions for the corner tie bracket 40, the panels 24 and 30, and corner blocks 22 may represent a preferred embodiment for a given ICF system.

For a particular application, it is further recognized and anticipated that the side members 42 and 44, the corresponding flange members 54 and 56, and the web members 52 may be encapsulated and/or embedded within the inner corner panel 24 and the terminal end portion 60 of the concrete engaging member 58 may be encapsulated and/or embedded within the outer corner panel 30. In addition, although FIGS. 6 and 7 show the terminal end portion 60 of the concrete engaging member 58 completely encapsulated within the inner panel, it is recognized and anticipated that the terminal end portion 60 of concrete engaging member 58 may be only partially encapsulated and/or embedded within one of the opposed panels forming the corner block 22 and still provide the necessary stability and rigidity thereto depending upon the particular application. In a similar manner, the web members 52 may likewise be only partially encapsulated and/or embedded within one of the corner block panels depending upon the particular application. Other variations and arrangements are likewise recognized and anticipated.

As is evident from the foregoing description, certain aspects of the present invention are not limited by the particular details of the examples illustrated herein and it is therefore contemplated that other modifications and applications, or equivalents thereof, will occur to those skilled in the art without impairing the teachings and practice of the present invention. Other variations and modifications to the various components comprising the present structure is also contemplated.

Thus, there has been shown and described several embodiments of a corner tie bracket for use in a wide variety of different types of ICF systems, which embodiments fulfill all of the objects and advantages sought therefore.

The invention claimed is:

1. A corner bracket member for use in a corner concrete form having a pair of spaced apart panels, the corner bracket member comprising:

at least a pair of side members, each side member having at least a pair of spaced apart flange members associated therewith, each flange member being sized and shaped for receiving and anchoring exterior facade or other surfaces, said at least a pair of side members sharing a common end portion; and at least one concrete-engaging member extending in a direction so as to extend completely across the space formed by and between the spaced apart corner form panels when the corner bracket member is attached thereto, said at least one concrete-engaging member having a terminal end portion which is encapsulated within one of the spaced apart corner form panels when the corner bracket member is attached thereto, said at least one concrete-engaging member having a longitudinal axis which is parallel to and offset laterally from a line bisecting the shared common end portion of said at least a pair of side members.

2. The corner bracket member defined in claim 1 including a web structure connecting said pair of side members, said at least one concrete-engaging member extending from said web structure.

3. The corner bracket member defined in claim 1 wherein the corner concrete form includes spaced apart inner and outer panels, the terminal end portion of said at least one concrete-engaging member being completely encapsulated within the inner panel and said side members and said flange members being completely encapsulated within the outer panel.

4. The corner bracket member defined in claim 1 wherein the terminal end portion of said at least one concrete-engaging member is elongated in a vertical direction to provide additional strength to the corner bracket member.

5. The corner bracket member defined in claim 4 wherein said elongated terminal end portion functions as a flange member for attaching other surfaces thereto.

6. The corner bracket member defined in claim 1 wherein at least one flange member includes an area of extra material to provide additional strength thereto.

7. The corner bracket member defined in claim 6 wherein said area of extra material tapers off in thickness laterally towards the respective side edges of said at least one flange member.

8. The corner bracket member defined in claim 1 wherein the corner concrete form includes spaced apart inner and outer panels, the terminal end portion of said at least one concrete-engaging member being completely encapsulated within the outer panel and said side members and said flange members being completely encapsulated within the inner panel.

9. The corner bracket member defined in claim 1 wherein each of said flange members extend substantially the full height of the corner concrete form.

10. A one-piece corner bracket member for use in a corner concrete form having a pair of spaced apart inner and outer panels, the corner bracket member comprising:

at least a pair of side members, each side member having at least a pair of flange members which function as anchors for attaching exterior façade or other surfaces thereto, said at least a pair of side members sharing a common edge;

a web structure connecting said at least pair of side members;

said at least pair of side members, each of said flange members, and said web structure being encapsulated within the outer panel of the corner concrete form when said corner bracket member is attached thereto;

at least one concrete-engaging member extending from said web structure in a direction so as to extend completely across the space formed by and between the inner and outer corner form panels when said corner bracket member is attached thereto, said at least one concrete-engaging member having a terminal end portion which is encapsulated within the inner corner form panel when said corner bracket member is attached thereto, said at least one concrete-engaging member having a longitudinal axis extending in a direction which is parallel to and offset laterally from the line bisecting the shared common edge of said at least a pair of side members.

11. The corner bracket member defined in claim 10 wherein the terminal end portion of said at least one concrete-engaging member is elongated in the vertical direction.

12. A corner block concrete form comprising:

a pair of opposed spaced apart panels, each panel having top and bottom horizontal longitudinal edges, first and second vertical end portions, and inner and outer surfaces;

a plurality of ties extending between said pair of opposed panels for holding said panels in said spaced apart relationship; and at least one corner bracket member extending between said pair of opposed panels, said at least one corner bracket member including at least a pair of side members, each side member including at least a pair of spaced apart flange members, each flange member adapted for receiving and anchoring exterior facade or other surfaces thereto, said at least a pair of side members and said flange members being encapsulated within one of said opposed panels, and at least one concrete-engaging member extending completely across the space formed by and between said pair of opposed spaced apart panels, said at least one concrete-engaging member having a terminal end portion which is encapsulated within the other of said pair of opposed panels, said at least a pair of side members sharing a common edge portion and said at least one concrete-engaging member having a longitudinal axis extending in a direction which is parallel to and offset laterally from a line bisecting the shared common edge portion of said at least a pair of side members.

13. The corner block concrete form defined in claim 12 wherein at least some of said flange members extend substantially the full height of the corner block concrete form.

14. The corner block concrete form defined in claim 12 including at least two corner bracket members extending between said pair of opposed panels, said at least two corner bracket members being vertically stackably arranged in reversed relationship to each other such that the at least one concrete-engaging member associated with one of said at least two corner bracket members is offset laterally to one side of the at least one concrete-engaging member associated with the other of said at least two corner bracket members.

15. The corner block concrete form defined in claim 14 wherein the respective flange members mate with each other and extend substantially the full height of the corner block concrete form.

16. The corner block concrete form defined in claim 12 wherein said at least one corner bracket member includes a plurality of concrete-engaging members.

17. A corner block form comprising:

a pair of opposed inner and outer panels positioned and spaced apart in substantially parallel relationship to each other, each panel having top and bottom horizontal longitudinal edges, first and second vertical end portions, and inner and outer surfaces;

engagement means formed along the horizontal longitudinal edges and the first and second vertical end portions associated with each of said inner and outer panels for removably engaging one corner block form with another corner block form having similar and complimentary engagement means associated therewith when placed both side-by-side and vertically adjacent to each other;

a plurality of ties extending between said pair of opposed inner and outer panels for holding said panels in said spaced apart substantially parallel relationship;

at least two corner bracket members extending between said opposed inner and outer panels;

each corner bracket member including at least a pair of side members, a web structure connecting said at least a pair of side members, and at least a pair of flange members associated with each side member, each flange member functioning as an anchor for receiving exterior facade or other surfaces, said at least a pair of side members sharing a common edge, said side members, flange members and web structure being encapsulated within one of said inner and outer panels;

each corner bracket member further including at least one concrete-engaging member extending in a direction so as to extend completely across the space formed by and between the inner and outer opposed panels, said at least one concrete-engaging member having a terminal end portion which is encapsulated within the other of said inner and outer opposed panels, said at least one concrete-engaging member having a longitudinal axis which is parallel to and offset laterally from a line bisecting the shared common edge of said at least a pair of side members;

said at least two corner bracket members being vertically stackably arranged in reversed relationship to each other such that at least some of the respective flange members associated with one of said corner bracket members mate with at least some of the respective flange members associated with the other of said corner bracket members, such that the shared common edges associated respectively with said at least two corner bracket members mate with each other, and such that the longitudinal axis of said at least one concrete-engaging member associated with one of said at least two corner bracket members is offset laterally to one side of a line bisecting the shared common edges of said at least two corner bracket members and the longitudinal axis of said at least one concrete-engaging member associated with the other of said at least two corner bracket members offset laterally to the opposite side of a line bisecting the shared common edges of said at least two corner bracket members.

* * * * *